US007333739B2

(12) United States Patent
Miyata

(10) Patent No.: US 7,333,739 B2
(45) Date of Patent: Feb. 19, 2008

(54) TONER NEAR EMPTY STATE DETECTION SYSTEM

(75) Inventor: Shungo Miyata, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 132 days.

(21) Appl. No.: 11/078,062

(22) Filed: Mar. 10, 2005

(65) Prior Publication Data

US 2007/0003296 A1 Jan. 4, 2007

(51) Int. Cl.
*G03G 15/08* (2006.01)

(52) U.S. Cl. ..... 399/27; 399/28; 399/30

(58) Field of Classification Search ..... 399/27–30
See application file for complete search history.

(56) References Cited

U.S. PATENT DOCUMENTS

| | | | | |
|---|---|---|---|---|
| 5,826,134 | A | 10/1998 | Hino et al. | |
| 6,118,951 | A * | 9/2000 | Kato et al. | 399/27 |
| 6,289,182 | B1 | 9/2001 | Umezawa et al. | |
| 2003/0091353 | A1* | 5/2003 | Hiroshima et al. | 399/27 |
| 2003/0133722 | A1* | 7/2003 | Kaiho | 399/27 |

* cited by examiner

*Primary Examiner*—David M. Gray
*Assistant Examiner*—Laura K Roth
(74) *Attorney, Agent, or Firm*—SoCal IP Law Group LLP; Steven C. Sereboff; John E. Gunther

(57) ABSTRACT

In an image forming apparatus of a type wherein toner is replenished to a developing unit by turning or rotating a toner bottle, a phenomenon that a toner replenishment amount per turn of the bottle (replenishing rate) is decreased as the toner remaining quantity in the bottle is decreased, is utilized to provide a method and an apparatus for easily and reliably determining a toner near empty state when a number of the turns measured by counting a number of detection of an object to be sensed formed on an outer surface of the toner bottle.

15 Claims, 5 Drawing Sheets

TONER NEAR EMPTY STATE DETECTION SYSTEM

BACKGROUND OF THE INVENTION

1. Field of the Invention

The present invention relates to a system (i.e. method and apparatus) for detecting a near empty state of a toner bottle used for replenishing a developing unit with a toner in an image forming apparatus using a toner.

2. Related Background Art

In an ordinary apparatus for image formation using a toner, such as an electrophotographic apparatus, it is a general practice to dispose a toner bottle or cartridge (hereinafter, representatively called "bottle") for replenishing a developing unit with a toner, as desired, depending on the toner quantity in the developing unit. In this instance, it is desired to monitor the toner bottle so that a fresh toner can be incessantly replenished in response to a demand from the developing unit and, on reaching a near empty state close to an empty state, a spare toner bottle is provided so as to allow an immediate exchange of the toner bottle on reaching the empty state and obviate the interruption of a necessary image forming operation. For the detection of such a near empty state of toner bottle, there has been adopted a method of detecting a remaining quantity of toner in and a near empty state of a toner bottle based on a change in rotation speed of the toner bottle required for the replenishment which speed varies depending on the toner remaining quantity in the bottle (Japanese Laid-Open Application No. 2001-35934 (JP-A 2001-35934, U.S. Pat. No. 6,289,182)), or a method of detecting a near empty state when a number of replenishment times by rotation of a toner replenishing roller for supplying a toner from a toner bottle to a developing unit reaches a prescribed number for judgment of toner empty under a correction with a certain correction factor (JP-A10-207212, U.S. Pat. No. 5,286,134).

However, the former method of judging a near empty state based on a change in rotation speed of a toner bottle involves a problem that a large fluctuation occurs in motor torque or load of the rotation mechanism. Further, the latter method based on the replenishment times by the replenishing roller involves a problem that the corrective judgment with a correction factor is complicated so that a good accuracy of judgment of the near empty state cannot be attained.

SUMMARY OF THE INVENTION

Accordingly, principal objects of the present invention are to provide a method and an apparatus for easily and reliably detecting a near empty state of toner bottle.

According to my study regarding an image forming apparatus of the type wherein a toner is replenished to a developing unit by rotating or turning a toner bottle per se, it has been found possible to easily and reliably detect a near empty state of the toner bottle by utilizing a phenomenon that the toner replenishing speed (i.e., toner replenishing amount per one rotation of the bottle) is decreased as the remaining amount of toner in the bottle is decreased.

More specifically, according to the present invention, there is provided a toner near empty state detection method, comprising:

a step of detecting a level of remaining quantity of toner in a developing unit;

a step of starting toner replenishment from a toner bottle to the developing unit when the toner remaining quantity level is lowered to a replenishment start level;

a step of detecting an object to be sensed formed on an outer surface of the toner bottle by sensor and counting a number of rotation of the bottle based on the number of detection of the object by the sensor;

a step of stopping the toner replenishment from the toner bottle to the developing unit by stopping the rotation of the toner bottle when the toner remaining quantity level in the developing unit is increased to a replenishment stop level; and a step of judging a near empty state of the tone bottle when a number of rotation of the toner bottle from the toner replenishment start to the toner replenishment stop has reached a prescribed value.

According to the present invention, there is further provided a toner near empty state detection apparatus, comprising:

a motor for rotating a toner bottle;

a motor driver for driving the motor;

a sensor for detecting an object to be sensed formed on an outer surface of the toner bottle to issue a detection signal;

a toner remaining quantity level sensor disposed in a developing unit for detecting a toner remaining quantity in the developing unit to issue a toner remaining quantity level signal; and a CPU for judging a near empty state of the toner bottle based on the detection signal and the toner remaining quantity level signal;

wherein said CPU controls the motor driver to start the rotation of the toner bottle when the toner remaining quantity level signal has reached a toner replenishment start level, controls the motor drive to stop the rotation of the toner bottle when the toner remaining quantity level signal has reached a toner replenishment stop level, counts a number of the rotation of the toner bottle based on the detection signal accompanying the rotation of the toner bottle, and issues an output of judging a near empty state of the toner bottle when the number of rotation of the toner bottle from the rotation start to the rotation stop (the number of rotation per one replenishing operations) has reached a prescribed value.

DETAILED DESCRIPTION OF THE INVENTION

Hereinbelow, some embodiments of the present invention will be described with reference to the drawings, but they are intended to be illustrative only and are not intended to restrict the method and apparatus of the present invention.

Figure 1:
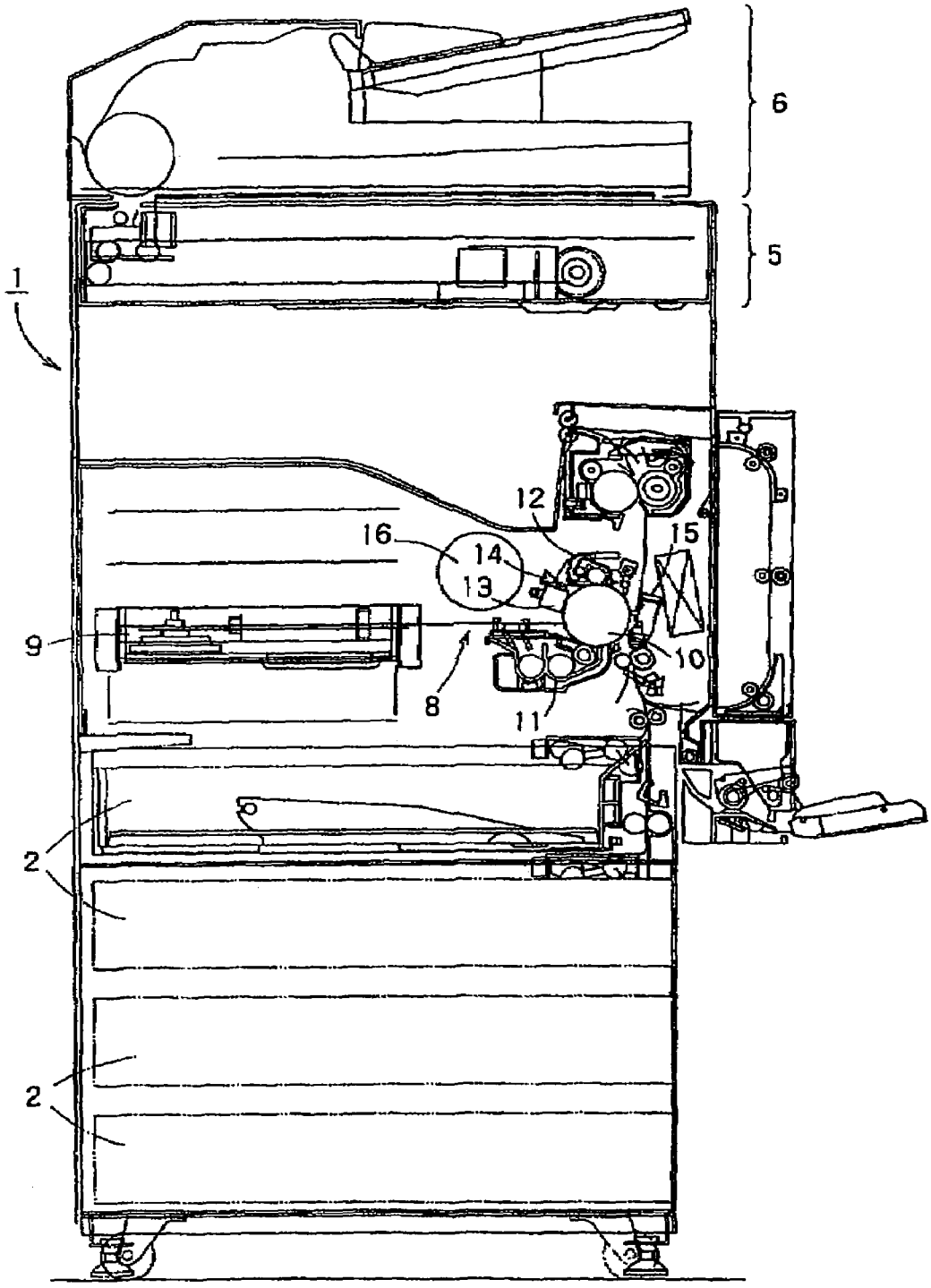
FIG. 1 is a longitudinal sectional view for illustrating an outline of a copying machine as an example of image forming apparatus to which the present invention is applied.

First of all, an overall organization of a copying machine as an example of image forming apparatus using a toner is illustrated in FIG. 1. A copying machine 1 includes cassette paper feed units 2 containing a large number of transfer sheets in the lower portion of the machine.

The upper portion of the copying machine 1 includes an image reader 5 for reading an original, an automatic document feeder 6 for supplying an original to this image reader 5, an image storage unit (not shown) for storing image data read by the image reader 5, and a laser optical device 9 for extracting the stored image data and forming a visible image by irradiating an image forming unit 8 with a laser beam.

The image forming unit 8 is composed of a photosensitive drum 10, a developing unit 11, a cleaner 12, a charger 13, a discharge lamp 14, and a transfer/separation charger 15. The developing unit 11 has a drive unit 17 for rotating a toner bottle 16, and the toner bottle 16 is loaded onto the drive unit in a positional relationship shown in FIG. 2.

A cap 20 having a discharge port 21 is placed at an opening portion of the toner bottle 16. A rib 24 as an example of object to be sensed is formed on a portion of the outer surface at the end portion away from the opening portion of the toner bottle 16. This rib 24 also functions to judge whether the toner bottle is a normal product or not, and has a predetermined positional relationship with the discharge port 21 of the cap 20. The discharge port 21 can have any arbitrary shape suitable for discharge of toner from the bottle, such as a circle, other than a rectangle as illustrated.

Figure 2:
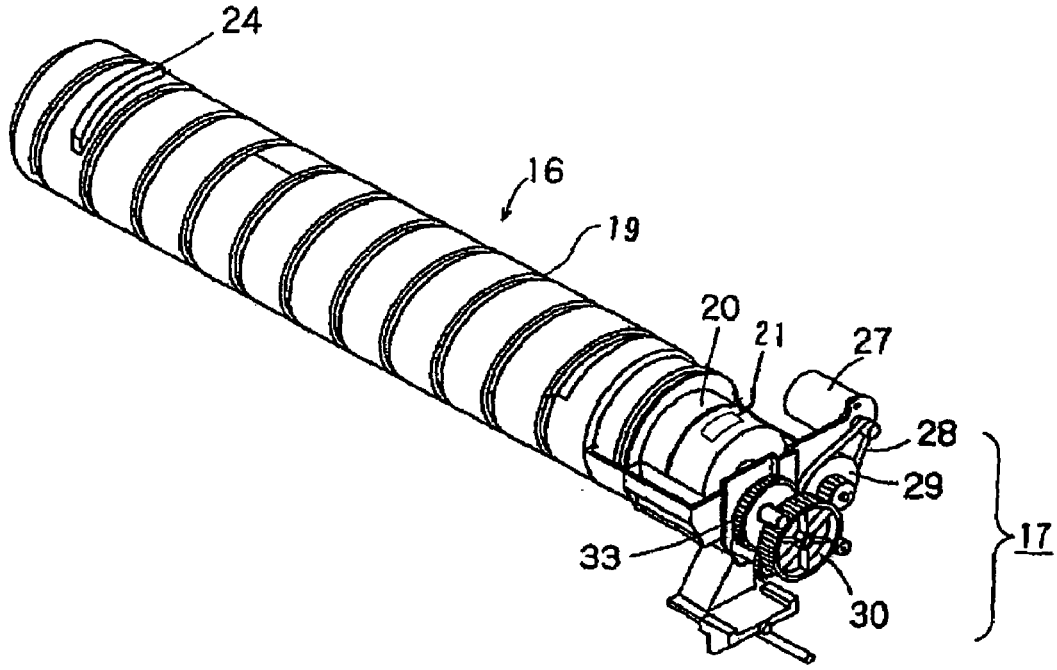
FIG. 2 is a perspective view showing a combination a toner bottle and a drive unit in the copying machine.
Figure 3:
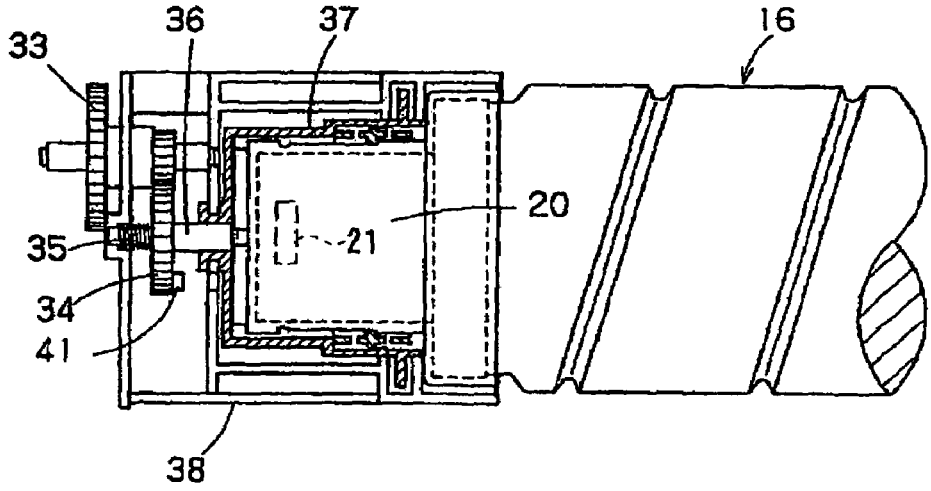
FIG. 3 is a sectional view showing a rotation mechanism in the drive unit.

A rotating mechanism including driving gears and the like, which is a part of the driving unit 17 for rotating the toner bottle 16, will be described below with reference to FIGS. 2 and 3. Referring to FIG. 2, the driving unit 17 includes a motor 27, a pulley 29, a belt 28 for transmitting the rotation of the motor 27 to the pulley 29, a driving gear A30 to which the rotation of the pulley 29 is transmitted, a driving gear B (not shown) to which the rotation of the driving gear A30 is transmitted, a conveyor auger for converting the rotation of the driving gear B into linear motion, and a driving gear 33 for converting the linear motion of the conveyor auger into rotation. Referring to FIG. 3, the driving unit 17 includes a driving gear D34 for transmitting the rotation of the driving gear C30, a driving plate 36 attached to the rotating shaft of the driving gear D34, the driving gear D34 attached to the driving plate 36 to slide along the axial direction, and a holder guide 37 attached to the driving plate 36 and rotated together with the driving plate 36 by the driving gear D34.

Figure 4:
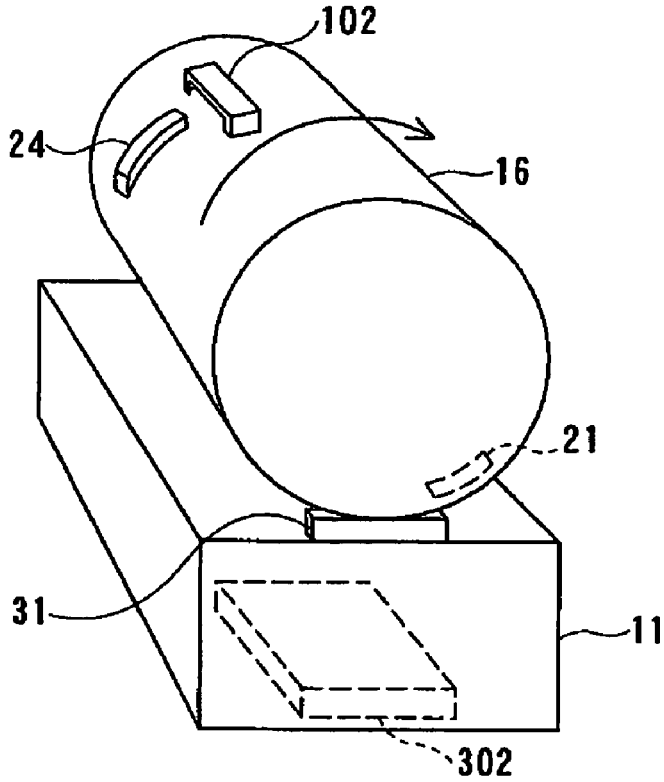
FIG. 4 is a schematic sectional view showing an embodiment of positional relationship of a toner bottle and a developing unit.

The toner bottle 16 is rotatably loaded on the copying machine body in such a positional relationship with respect to the developing unit 11 as schematically illustrated in FIG. 4. The rotation thereof is controlled by detecting the rib 24 formed on the outer surface of the bottle 16 by a sensor 102 disposed on the machine body side. When the toner discharge hole (replenishing port) 21 on the bottle side and a replenishing port 31 on the developing unit 11 side are positionally aligned, the toner is replenished from the toner bottle 16 to the developing unit 11. The remaining quantity of toner in the developing unit 11 is detected by a toner remaining quantity level sensor 302 disposed in the developing unit.

Figure 5A:
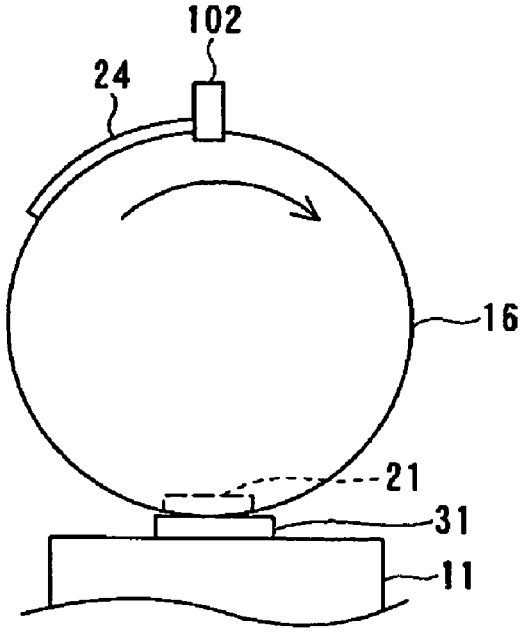
FIGS. 5A and 5B are longitudinal sectional views each showing a positional relationship of an object to be sensed, a sensor and a toner discharge port of a bottle according to a preferred embodiment of the present invention.
Figure 5B:
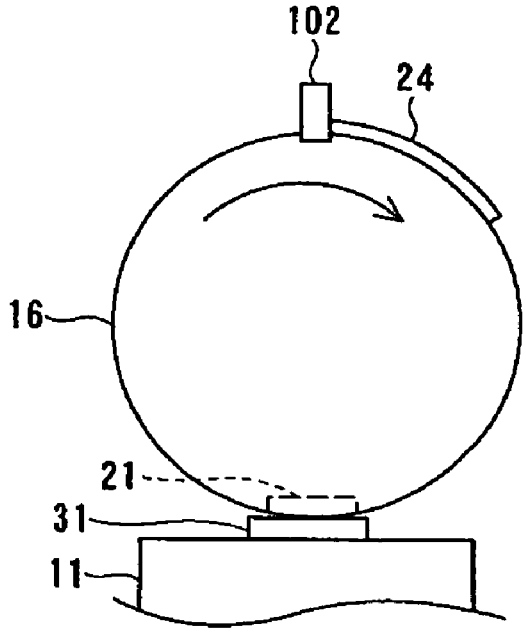

The rib 24 formed on the toner bottle 16 and the toner discharge hole 21 may preferably be in such a positional relationship that during the rotation of the toner bottle 16, the time of detection of the rib 24 by the sensor 102 is synchronized with the time of toner replenishment to the developing unit 11. More specifically, it is preferred that at a start position of detection (FIG. 5A) or a finish position of detection (FIG. 5B) of the rib 24 by the sensor 102, the toner discharge hole 21 on the toner bottle 16 side and the toner replenishing port 31 on the developing unit 11 side are positionally aligned to effect a toner replenishment.

Figure 6A:
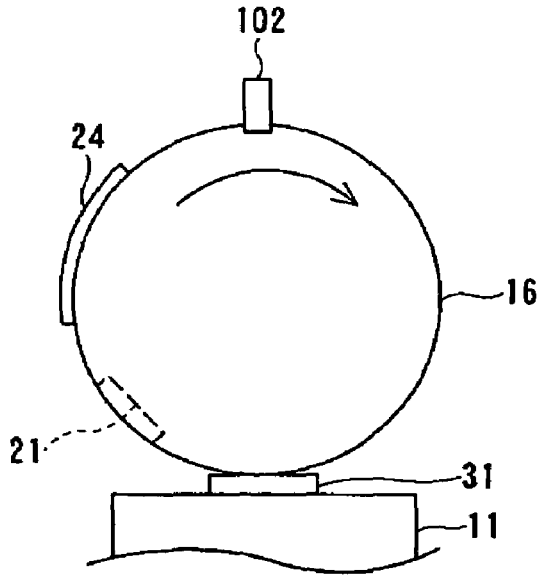
FIGS. 6A and 6B are longitudinal sectional views each showing a positional relationship of an object to be sensed, a sensor and a toner discharge port of a toner bottle according to an embodiment other than above-mentioned preferred embodiment.
Figure 6B:
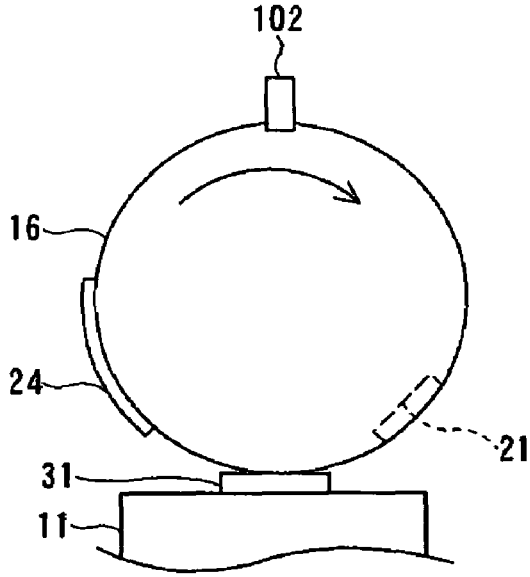

In contrast thereto, in case where the rib 24 and the toner discharge hole 21 are placed in a positional relationship as illustrated in FIG. 6A or FIG. 6B during rotation of the toner bottle 16, it becomes impossible to judge whether the time of detection of the rib 24 by the sensor 102 is before or after the toner replenishment performed by the positional alignment of the replenishing ports 21 and 31, so that there arises an error or difference between the number of detection of the rib 24 by the sensor 102 and the number of rotation for the toner replenishment. As a result, compared with the case of FIG. 5A or FIG. 5B where such a difference is not caused, there occurs a fluctuation in measurement result of toner replenishment speed based on the number of rotation of the toner bottle 16, consequently resulting in a lowering in accuracy of detection of a near empty state of the toner bottle 16. The sensor 102 can be of any type as long as it can sense the presence of the rib 24. An optical sensor and a mechanical limit SW are examples.

It is also possible to attach a magnetic material, as another example of the object to be sensed, to the surface of a toner bottle and allow a magnetic sensor to sense this material. Alternatively, it is possible to attach an optically sensible mark such as a bar code to the surface of a toner bottle and permit an optical sensor to sense this mark. That is, it is only necessary to allow a sensor to sense a portion to be discriminated.

It is also preferred that the outer surface of the toner bottle is provided with a spiral groove 19 (forming a projection inside the bottle), and in this case, the bottle can be rotated in a forward direction for promoting the movement of the contained toner toward the discharge port 21 or in a reverse direction for obstructing the movement. For the purpose of the present invention, the toner bottle is ordinarily rotated in the forward direction, but the rotating mechanism can be so organized as to allow a rotation in the reverse direction, as desired, for the purpose of, e.g. stabilizing a flowability state of the contained toner at an initial stage after the loading of the bottle.

It is also possible to set a blank rotation period, as desired, wherein the toner replenishment is not effected in spite of the bottle rotation, and omit the number of blank rotation from the number of rotation for the replenishment.

Figure 7:
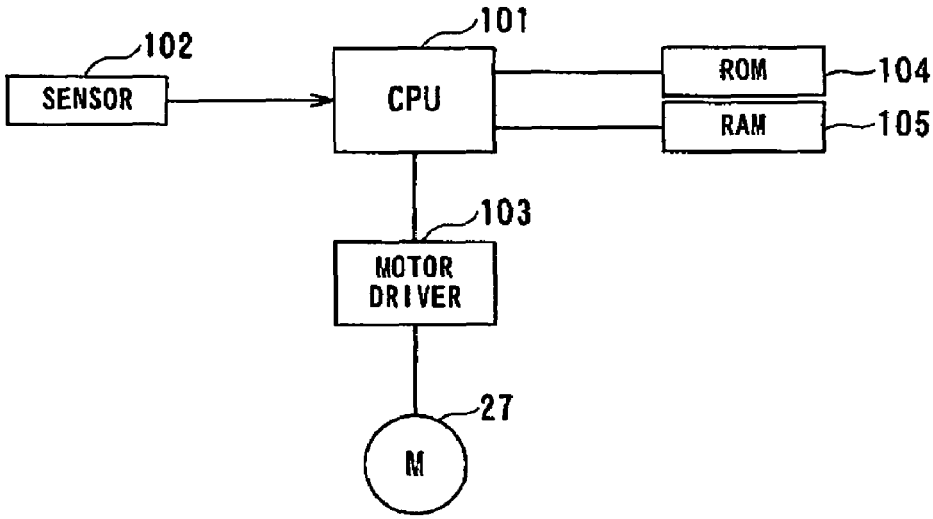
FIG. 7 is a block diagram showing an apparatus organization according to an embodiment of the present invention.

The toner near empty state detection system according to the present invention includes a control circuit shown in FIG. 7 in order to control the rotation of the toner bottle 16 and perform processing such as discrimination.

This control circuit includes a CPU (Central Processing Unit) 101, a ROM 104, a RAM 105, a sensor 102, and a motor driver 103. The CPU 101 manages the whole operation of the copying machine 1. The ROM 104 stores programs for designating the operation procedure of the CPU 101. The RAM 105 stores data and data is read out from the RAM 105 where necessary under the control of the CPU 101. The sensor 102 senses the rib 24 of the toner bottle 16 and outputs a sensor signal to the CPU 101. The motor driver 103 receives a control signal from the CPU 101 and drives the motor 27 for rotating the toner bottle 16.

In accordance with the procedures to be described later with reference to flow charts, the CPU 101 outputs a control signal to the motor driver 103 and causes the motor driver 103 to drive the motor 27. The motor 27 rotates the toner bottle 16, and the sensor 102 senses the rib and outputs a sensor signal to the CPU 101. On the basis of this sensor signal, the CPU 101 counts the number of rotation or turns of the toner bottle and detects a near empty state.

Figure 8:
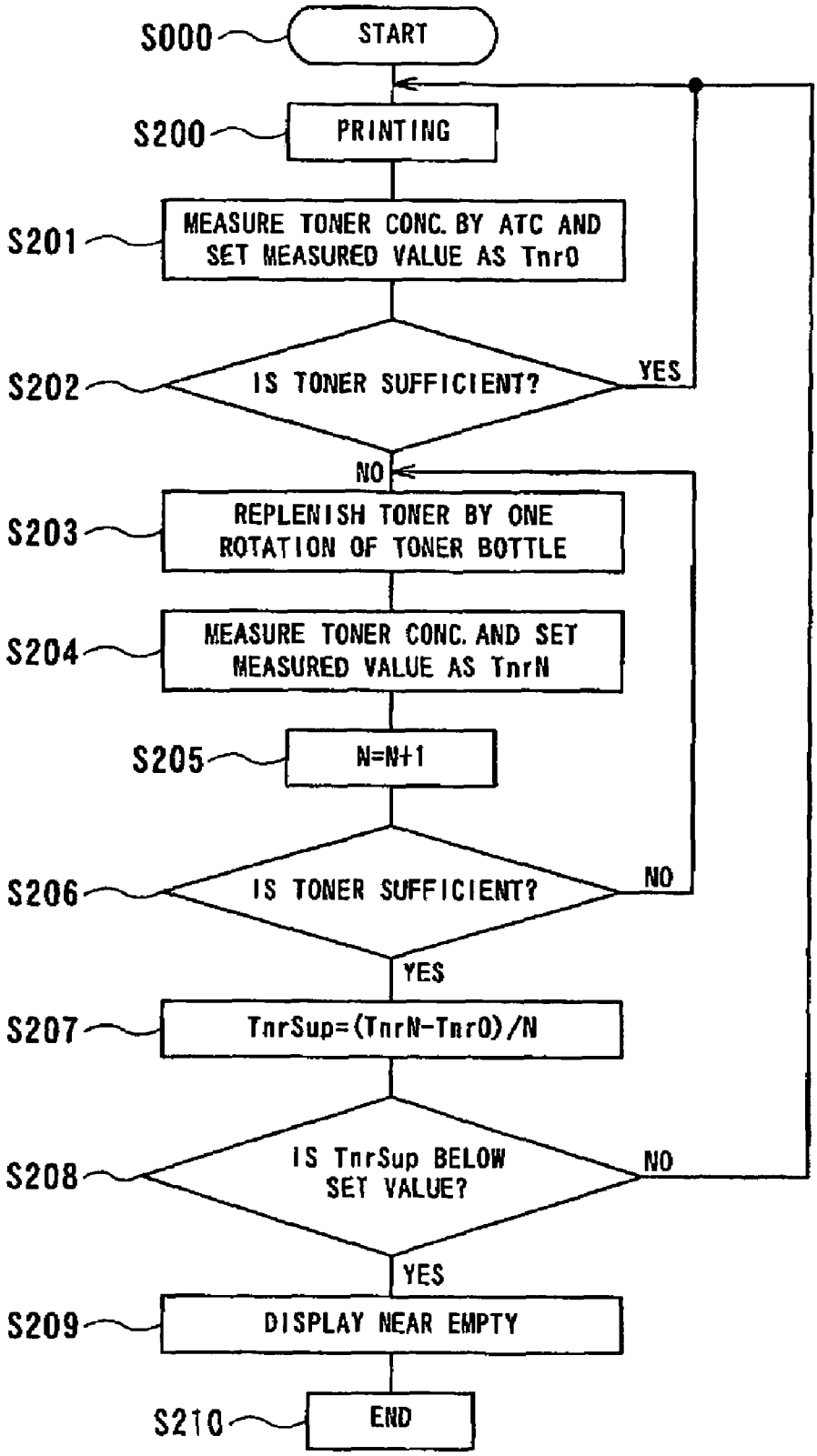
FIG. 8 is a flow chart showing an operation procedure in one embodiment of the toner near empty state detection method of the present invention.

An embodiment of the toner near empty state detection method according to the present invention will now be described with reference to a flow chart shown in FIG. 8. In this embodiment, a toner concentration is measured as an indication of toner remaining amount in the developing unit 11 by an automatic toner sensor.

First, the operation is started at step S000 by a user's action of power switch ON.

Then, at step S200, according to a user's action of copy button ON, a printing operation (image forming operation such as copying or printing) on a prescribed number of sheets, is performed. Then, at step S201, a toner concentration is measured and designated as Tnr0.

Then, at step S202, if the measured toner concentration is higher than a level requiring toner replenishment (denoted by TnRL), the toner is judged to be sufficient (YES) and the system is prepared for a next step of S200 (printing operation). However, if the measured toner concentration is lowered down to the level requiring toner replenishment (TnRL), the toner is judged to be not sufficient (NO), and the system enters a series of toner replenishment cycle starting from step S203.

First, at step S203, the motor 27 is driven to cause one turn or rotation of the toner bottle 16 to effect toner replenishment, and at step S204, the toner concentration in the developing unit 11 is measured and denoted by TnrN (initially N=0). Further, at step S205, 1 more turn of the toner bottle is caused (N=N+1). Then, at step S206, judgment is made as to whether the toner concentration TnrN measured at step S204 has increased to a level sufficient to terminate the toner replenishment (TnRH), and if NO, step S203 is resumed to repeat the bottle turn. On the other hand, if TnrN has increased to TnRH, the toner replenishment cycle is finished to enter a subsequent replenishing rate judgment step starting from step S207.

At step S207, an increase of toner concentration per turn of the toner bottle (i.e. replenishing amount or replenishing effect per turn) is calculated according to the formula of TnrSup=(TnrN−Tnr0)/N. Then, at step S208, judgment is made as to whether TnrSup calculated above has decreased to a level requiring a display of near empty state is (TnrNE), and if NO, the system is prepared for a user's order of copy operation starting fro step S200. On the other hand, if TnrSup has decreased down to TnrNE, at step 209, a near empty state display is made at an operation display unit of the main assembly of the copying machine, thereby terminating a series of near empty state detection operation at step S210.

The arrival at the near empty state does not mean an arrival at a state where a copying operation is impossible. Accordingly, as a mode subsequent to the near empty state display, there may be adopted a mode wherein the level of TnrNE requiring a display of near empty state at the step S208 is reset to 0 and the copying operation can be continued until the print density is unacceptably lowered according to a user's judgment, or a mode wherein in consideration of the durability of the entire apparatus, a toner concentration level requiring an empty state TnrE (<TnrNE) is set at the step S208 to display an empty state instead of a near empty state, optionally further followed by a mode wherein the system does not respond to a user's order of copying operation.

The embodiment of near empty state detection described with reference to FIG. 8 can be operated with various modifications.

For example, even during the continuation of copying operation ordered by a user, the toner concentration can be continually measured by the ATC 302 in the developing unit 11, so that it is possible to adopt a mode wherein if the measured concentration Tnr0 is lowered down to a level TnRLL which is lower than the above-mentioned level TnRL requiring toner replenishment, the system is forced to enter the toner replenishment cycle starting from the step S203.

Further, it is possible to add a mode of effecting bottle rotation for toner replenishment for a certain period of time in proportion to a number of copied sheets at step S200.

In the above embodiment, it is preferred from a viewpoint of good measurement accuracy that the measurement of toner concentration by ATC in the developing unit 11 is effected according to a scheme of measuring a change in permeability corresponding to a toner concentration change and converting the permeability change into a voltage as an indicator of toner concentration. This is especially effective in a type of image forming apparatus wherein during continuation of printing operation, only a non-magnetic toner is supplied to a developing unit containing a two-component type toner comprising a magnetic toner and a non-magnetic toner. However, in the toner near empty state detection system according to the present invention, it is also possible to adopt a method of optically measuring a color change corresponding to a toner concentration change in a two-component type toner, or a method of measuring toner remaining quantity in a developing unit directly as a change of volume or height level which is also applicable to a mono-component type toner.

Further, in the above-described embodiment, TnrSup is determined and is compared with a set value, but it is also possible to adopt a more direct mode wherein a number of turns N of toner bottle required for one replenishing cycle is measured as a direct indicator, and if N has increased to a prescribed number or more, a near empty state is displayed.

As described above, according to the present invention, there are provided a method and an apparatus for easily and reliably detecting a near empty state of a toner bottle for an image forming apparatus of a type wherein a toner is replenished to a developing unit by turning or rotating a toner bottle, by utilizing a phenomenon that an amount of toner replenishment per bottle turn (replenishing rate) is decreased as the toner remaining quantity in the bottle is decreased and by measuring a number of turns determined by counting an number of detection of an object to be sensed formed on an outer surface of the toner bottle so as to allow judgment of near empty state where the number of turns required for one replenishing operation reaches a prescribed value or more.

What is claimed is:

1. A toner near empty state detection method, comprising:

detecting a level of remaining quantity of toner in a developing unit;

starting toner replenishment from a toner bottle to the developing unit when the toner remaining quantity level is lowered to a replenishment start level;

detecting an object to be sensed formed on an outer surface of the toner bottle by a sensor and counting a number of rotations of the bottle based on the number of detection of the object by the sensor;

stopping the toner replenishment from the toner bottle to the developing unit by stopping the rotation of the toner bottle when the toner remaining quantity in the developing unit is increased to a replenishment stop level;

judging a near empty state of the toner bottle based on a number of rotations of the toner bottle from the toner replenishment start to the toner replenishment stop in one replenishing operation.

2. A method according to claim 1, wherein the toner remaining quantity level in the developing unit is determined based on a toner concentration.

3. A method according to claim 2, wherein the toner concentration is determined based on a change in permeability.

4. A method according to claim 1, wherein during rotation of the toner bottle, a time of toner replenishment to the developing unit is coincident with a time of detection of the object to be sensed by a sensor.

5. A method according to claim 1, wherein during the rotation of the toner bottle, a state of the detection of the object to be sensed by a sensor continues for a certain period, and the time of detection start or the time of detection finish is coincident with the time of toner replenishment to the developing unit.

6. The toner near empty state detection method of claim 1, wherein judging a near empty state of the toner bottle further comprises:

judging a near empty state of the toner bottle when the number of rotations of the toner bottle from the toner replenishment start to the toner replenishment stop in one replenishing operation has reached a prescribed level.

7. The toner near empty state detection method of claim 1, wherein judging a near empty state of the toner bottle further comprises:

calculating an amount of toner supplied per rotation of the toner bottle; and judging a near empty state of the toner bottle when the amount of toner supplied per rotation of the toner bottle falls below a prescribed level.

8. A toner near empty state detection apparatus, comprising:

a motor which rotates a toner bottle;

a motor driver which drives the motor;

a sensor which detects an object to be sensed formed on an outer surface of the toner bottle to issue a detection signal;

a toner remaining quantity level sensor disposed in a developing unit, wherein the level sensor detects a toner remaining quantity in the developing unit to issue a toner remaining quantity level signal; and a CPU which judges a near empty state of the toner bottle based on the detection signal and the toner quantity remaining level signal;

wherein said CPU controls the motor driver to start the rotation of the toner bottle when the toner remaining quantity level signal has reached a toner replenishment start level, controls the motor driver to stop the rotation of the toner bottle when the toner remaining quantity level signal has reached a toner replenishment stop level, counts a number of the rotation of the toner bottle based on the detection signal accompanying the rotation of the toner bottle, and issues an output of judging a near empty state of the toner bottle based on the number of rotations of the toner bottle from the rotation start to the rotation stop in one replenishing operation.

9. An apparatus according to claim 8, wherein said object to be sensed is formed over length on the outer surface of the toner bottle, and the toner bottle is provided with a toner discharge hole so that, during rotation of the toner bottle, a start position or finish position is aligned with a position of toner replenishment from the toner bottle to the developing unit.

10. The toner near empty state detection apparatus of claim 8, wherein issuing an output of judging a near empty state of the toner bottle further comprises:

judging a near empty state of the toner bottle when the number of rotations of the toner bottle from the toner replenishment start to the toner replenishment stop in one replenishing operation has reached a prescribed level.

11. The toner near empty state detection apparatus of claim 8, wherein issuing an output of judging a near empty state of the toner bottle further comprises:

calculating an amount of toner supplied per rotation of the toner bottle; and judging a near empty state of the toner bottle when the amount of toner supplied per rotation of the toner bottle falls below a prescribed level.

12. An image forming apparatus, comprising:

a developing unit;

a motor which rotates a toner bottle;

a motor driver which drives the motor;

a sensor which detects an object to be sensed formed on an outer surface of the toner bottle to issue a detection signal;

a toner remaining quantity level sensor disposed in the developing unit, wherein the level sensor detects a toner remaining quantity in the developing unit to issue a toner remaining quantity level signal; and a CPU which judges a near empty state of the toner bottle based on the detection signal and the toner quantity remaining level signal;

wherein said CPU controls the motor driver to start the rotation of the toner bottle when the toner remaining quantity level signal has reached a toner replenishment start level, controls the motor driver to stop the rotation of the toner bottle when the toner remaining quantity level signal has reached a toner replenishment stop level, counts a number of the rotation of the toner bottle based on the detection signal accompanying the rotation of the toner bottle, and issues an output of judging a near empty state of the toner bottle based on the number of rotations of the toner bottle from the rotation start to the rotation stop in one replenishing operation.

13. The image forming apparatus according to claim 12, wherein said object to be sensed is formed over length on the outer surface of the toner bottle, and the toner bottle is provided with a toner discharge hole so that, during rotation of the toner bottle, a start position or finish position is aligned with a position of toner replenishment from the toner bottle to the developing unit.

14. The image forming apparatus according to claim 12, wherein issuing an output of judging a near empty state of the toner bottle further comprises:

judging a near empty state of the toner bottle when the number of rotations of the toner bottle from the toner replenishment start to the toner replenishment stop in one replenishing operation has reached a prescribed level.

15. The image forming apparatus according to claim 12, wherein issuing an output of judging a near empty state of the toner bottle further comprises:

calculating an amount of toner supplied per rotation of the toner bottle; and judging a near empty state of the toner bottle when the amount of toner supplied per rotation of the toner bottle falls below a prescribed level.

* * * * *